US005210910A

United States Patent [19]

Hellwig

[11] Patent Number: 5,210,910

[45] Date of Patent: May 18, 1993

[54] BUNDLING STRAP EMPLOYING FLAT BLANK WITH ONE END HAVING SIDE TOOTH AND OTHER END FOLDABLE INTO SLOT WITH TOOTH-ENGAGING THROUGH HOLE

[76] Inventor: John W. Hellwig, 2838 Woolsey St., Berkeley, Calif. 94705

[21] Appl. No.: 734,472

[22] Filed: Jul. 23, 1991

[51] Int. Cl.[5] ..... B65D 63/10

[52] U.S. Cl. ..... 24/17 A; 24/16 R

[58] Field of Search ..... 294/149; 24/16 R, 16 PB, 24/30.5 R, 30.5 P, 17 R, 17 A, 17 AP, 20 EE

[56] References Cited

U.S. PATENT DOCUMENTS

| | | | |
|---|---|---|---|
| 2,023,059 | 12/1935 | Vaughan . | |
| 2,035,351 | 3/1936 | Taylor . | |
| 3,009,220 | 11/1961 | Fein | 24/16 PB |
| 3,146,012 | 8/1964 | King, Sr. | 24/16 PB X |
| 3,486,200 | 12/1969 | Orenick | 24/16 PB |
| 3,618,173 | 11/1971 | Schwartz . | |
| 3,860,997 | 1/1975 | Van Riper, Jr. . | |
| 4,008,512 | 2/1977 | Prodel | 24/16 PB |
| 4,165,111 | 8/1979 | Zanichelli | 24/16 PB X |
| 4,823,442 | 4/1989 | Behr | 24/16 PB X |
| 4,951,362 | 8/1990 | Denemark et al. | 24/16 PB |
| 5,022,316 | 6/1991 | Hellwig . | |

FOREIGN PATENT DOCUMENTS

| | | | |
|---|---|---|---|
| 2436341 | 2/1976 | Fed. Rep. of Germany | 24/16 PB |

*Primary Examiner*—James R. Brittain

*Attorney, Agent, or Firm*—David Pressman

[57] ABSTRACT

A bundling strap for bundling various objects, such as newspapers (40). The strap consists of a tongue (2) (optional) on one end the strap, a locking portion (16) on the other end of the strap, a serrated portion (6) located between the tongue (2) and locking portion (16), and a smooth section (10) between the locking portion (16) and the tongue (2). The serrated portion has teeth (5 and 8) on both of its longitudinal sides, and the serrated portion has a pair of parallel holes (22 and 23) which are in line with the teeth, so that the teeth (5 and 8) can be inserted into the respective holes (22 and 23). The locking portion (16) has two bendable flaps (18 and 20). The flap (18) has a longitudinal slot (34) and the flap (20) is formed with a pointed tab (30). Bendable ears (32 and 33) are formed on the tab (30). In order to tie an object, such as the bundle (40), it is placed on section (10) of the bundling strap, which is laid flat on the ground. The ends of the bundling strap are then overlapped so that the teeth (5 and 8) mate with the holes (22 and 23). Next, the flaps are folded, and the tab (28) is inserted through the slot (34). In order to prevent the lock from opening, the ears (32 and 33) are folded at an angle to the direction of the longitudinal side edges of the strap to prevent the tab (28) from slipping back through the slot (34). The bundle is made snug by pulling the tongue (2) while holding the tang (36).

20 Claims, 3 Drawing Sheets

BUNDLING STRAP EMPLOYING FLAT BLANK WITH ONE END HAVING SIDE TOOTH AND OTHER END FOLDABLE INTO SLOT WITH TOOTH-ENGAGING THROUGH HOLE

BACKGROUND

1. Field of the Invention

The present invention relates to holding devices, particularly to bundling straps for securing articles such as newspapers or other items into neat, manageable bundles.

2. Description of Prior Art

Presently, a plurality of devices are used for bundling articles and holding them in a neatly bundled state.

One such holder, which is described in U.S. Pat. No. 3,860,997 to R. W. Van Riper, consists of a tab with a pair of notched sides and a buckle with a pair of resiliently attached toothed arms. The tab is locked in the buckle when the arms are moved adjacent to the tab and the teeth on the arms are maintained within a pair of notches on the tab. When the arms are moved away from the tab and the teeth are disengaged from the notches, the tab may be removed from the buckle.

Although this device is suitable for tying together bundles of cables, it has a relatively great thickness, which makes it inconvenient for transportation and storage, as well as unsuitable for stacking bundles onto each other. Additionally, to provide sufficient strength, this device is usually made of plastic, which is not recyclable.

Another such device, described in U.S. Pat. No. 3,618,173 to R. S. Schwarz, comprises a strap having a plurality of teeth on at least one longitudinal edge for engagement with at least one detent placed within a longitudinal passage extending through a head member formed as a portion of the strap.

This bundling strap is incrementally adjustable. However, it can not be reused due to the irreversible nature of its pawl mechanism, i.e., it is not disengageable. Additionally, to provide sufficient strength, this device is also usually made of plastic, which is not recyclable.

A metal strap joint, described in U.S. Pat. No. 2,023,059 to E. G. S. Vaughn, fastens when its tongues engage with slots. A lock is obtained by laying one end of the strap over the other end, ridging the overlapping portions of the strap, and forming tongues in one overlapping portion. The tongues engage in slots in the other overlapping portion and lie in a position where they are below the upper level of the ridged portion. However, the above strap joint is intended for heavy duty applications, expensive to manufacture, and is not suitable for household use.

A bale tie, described in U.S. Pat. No. 2,035,351 to A. B. Taylor, comprises a metal band with a plurality of rectangular teeth on each side and at each end of the band. Since the teeth are bent, the tension on the band causes the teeth to engage when the ends of the band are placed one over the other. This bundling device is intended for heavy duty only, and is not suitable for household applications, especially since its exposed metal teeth pose a considerable hazard.

A newspaper bundler is described in my earlier U.S. Pat. No. 5,022,316, granted Jun. 11, 1991, but this device uses a metal frame and adhesive attachments of its bundling straps, making it more expensive to manufacture.

OBJECTS AND ADVANTAGES OF THE INVENTION

It is therefore one object of the invention to eliminate the above disadvantages. Other objects and advantages are to provide a bundling strap that is inexpensive and simple to manufacture, e.g., by a single die-cut operation, convenient to store and transport, easy to use, can be adapted to bundle items of different sizes and shapes, is safe for household applications, allows bundles to be stacked on top of each other, and has a locking mechanism so strong that it can be made from a nonplastic and nonmetallic material, e.g., paper board, which is readily recycled. Further features and advantages of the invention will become apparent after the consideration of the ensuing description with reference to the accompanying drawings.

BRIEF DESCRIPTION OF DRAWINGS

FIGS. 1-7—DETAILED DESCRIPTION OF THE BUNDLING DEVICE OF THE INVENTION

A bundling strap made in accordance with one embodiment of the invention is shown in FIGS. 1 through 7 where FIG. 1 is a perspective view of the bundling strap in a state prefolded for storage and transportation. As can be seen from this drawing, the strap is a piece of cardboard which consists of the following main parts: a first pointed head 4; a serrated portion 6 with a plurality of uniformly spaced teeth 5 and 8 along both longitudinal edges thereof; a smooth section 10 of uniform width, which contains recesses 12 and 13 which form rounded shoulders 14 and 15 smoothly blending with section 10, and a locking section 16, which comprises flaps 18 and 20. Also an optional tongue 2 extends from the end of serrated portion 6.

Figure 2:
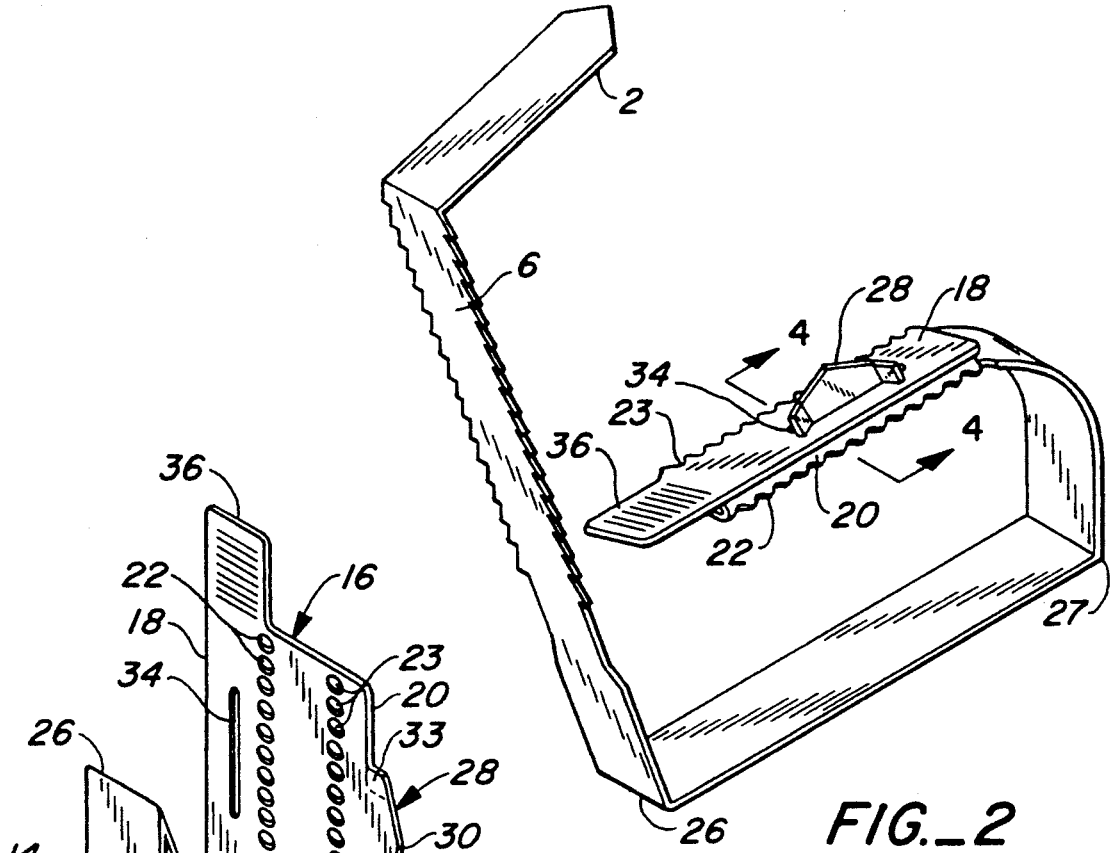
FIGS. 2 and 3 are perspective views illustrating sequential steps of folding the bundling strap of FIG. 1, an object to be bundled not shown.

As shown in the drawings, teeth 5 and 8 are inclined so that their apices are directed toward locking section 16.

Locking section 16 also contains two longitudinal rows of uniformly spaced round holes 22 and 23, centered on lines which are in effect continuations of the side edges of section 10. In each row, holes 22 and 23 have the same pitch as respective teeth 5 and 8. Furthermore, holes 22 and 23 are axially aligned with respective teeth 5 and 8. For purposes of stress relief, a pair of smaller holes 24 and 25 are placed at the apices of the two corners formed by sides of flaps 18, 20 and edges of section 10. Section 10 also has two reinforced bending seams 26 and 27, placed transversely in relation to the axis of the bundling strap, and spaced to accept a bundle of standard-size newspaper. A tab 28 with a second pointed head 30 and foldable ears 32 and 33 protrudes from the longitudinal edge of flap 20.

Flap 18, which is approximately twice as wide as flap 20, contains a longitudinal slot 34 that is just long and wide enough to accept tab 28 with its ears 32 and 33 unfolded when tab 28 is inserted into slot 34 (FIG. 2). Slot 34 is placed longitudinally in the center of flap 18, bisecting the width of flap 18. A pulling tang 36 forms an outward longitudinal extension of flap 18 and is slightly narrower than flap 18.

Figure 1:
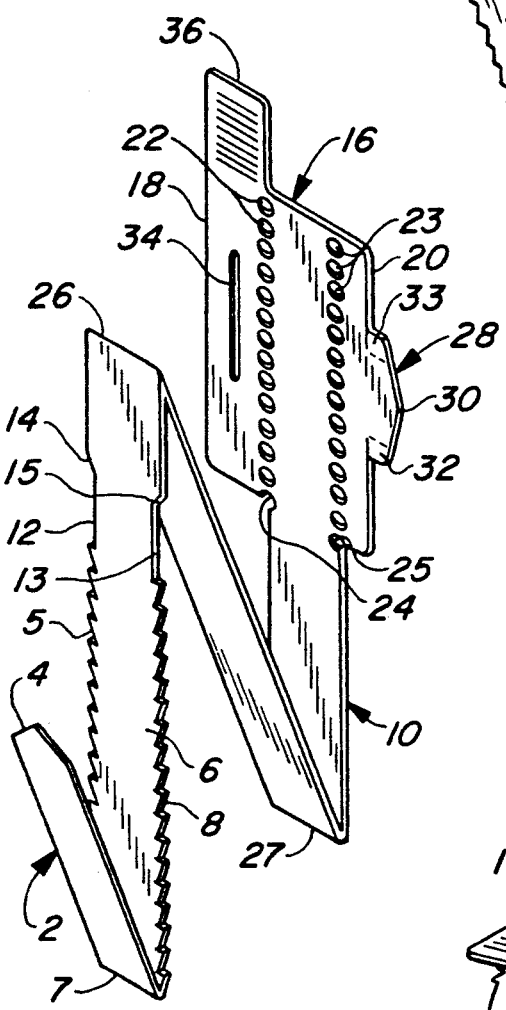
FIG. 1 is a perspective view of a bundling strap of the invention shown prefolded for storage.
Figure 3:
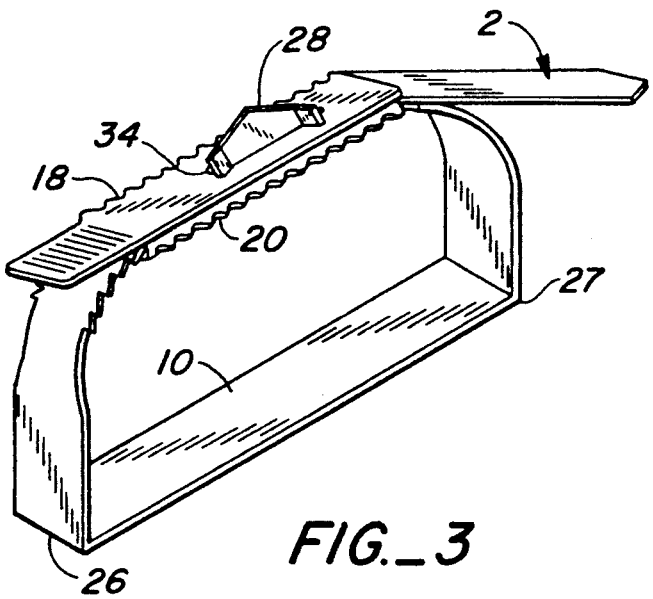

FIGS. 2 and 3 are perspective views illustrating sequential steps of folding the bundling strap of FIG. 1. The object to be bundled is not shown. In FIG. 2 the strap is shown partly folded to accept an imaginary bundle, such as a stack of newspapers, with flaps 18 and 20 folded and tab 28 locked, but tongue 2 not inserted into locking section 16 for the sake of clarity of the cross-sectional view of FIG. 4. FIG. 3 shows the strap in a completely folded and locked position, but again without the bundle.

Figure 4:
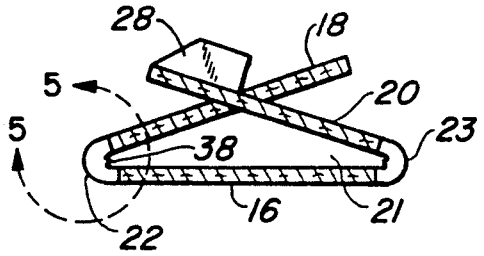
FIG. 4 is a cross-sectional view along lines 4—4 of FIG. 2.

FIG. 4 is a cross-sectional view along lines 4—4 of FIG. 2. In this drawing one can see the location of tab 28 after it has been inserted through slot 34, as well as holes 22 and 23, which lock teeth of the strap when section 6 is inserted into a space 21 formed by folded flaps 18 and 20.

Figure 5:
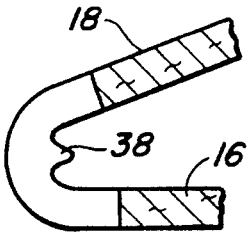
FIG. 5 is an enlarged view of a detail 5—5 of FIG. 4 illustrating the position of a locking detent.
Figure 6:
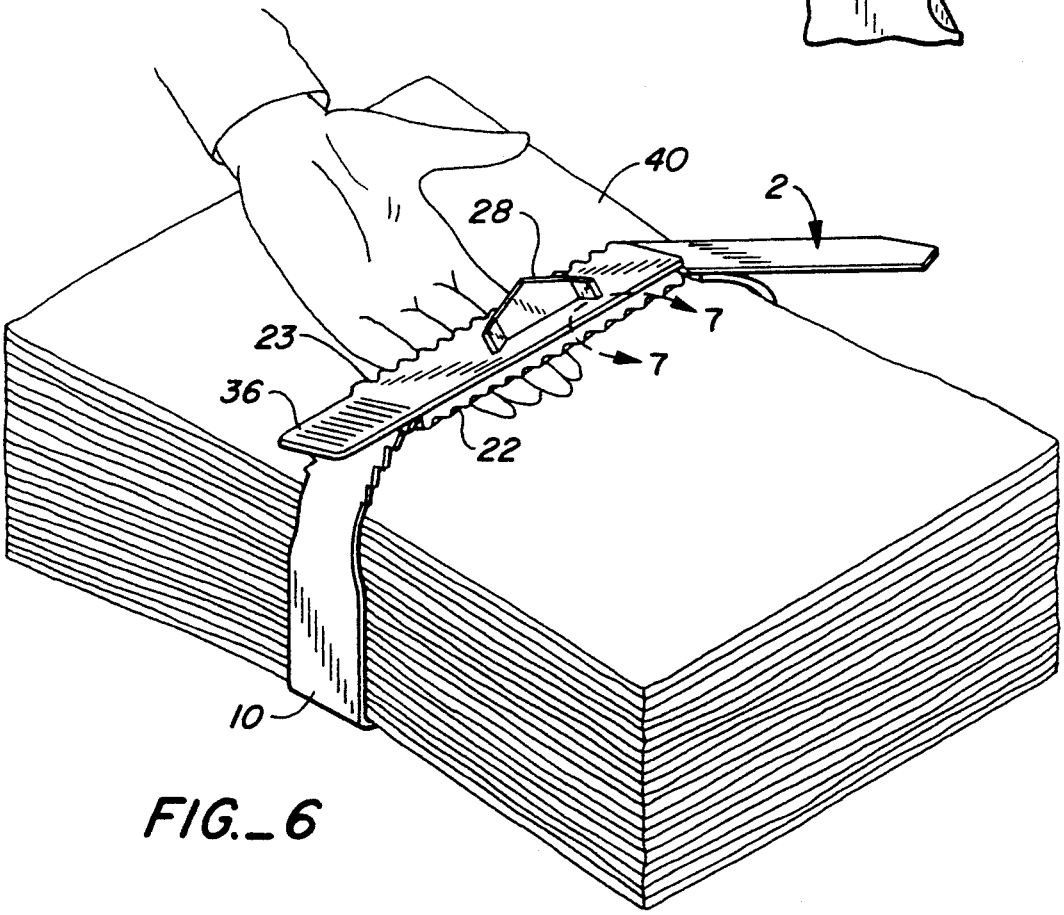
FIG. 6 is a perspective view illustrating a bundle of newspapers bound with the bundling strap of FIG. 1.

FIG. 5 is an enlarged view of a detail 5—5 of FIG. 4 illustrating the position of a locking detent 38 which is naturally formed between each pair of adjacent holes 22 and 23 in each row, when the paperboard is folded FIG. 6 is a perspective view illustrating a bundle 40 of newspapers bound with the bundling strap of FIG. 1. This view is identical to that of FIG. 3, with the exception that a bundle 40 of newspapers is shown and a hand is carrying the bundle with the strap.

Figure 7:
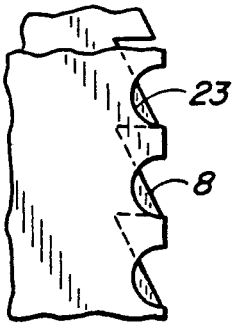
FIG. 7 is an enlarged fragmental view of a detail 7—7 of FIG. 6.

FIG. 7 is an enlarged fragmental view of a detail 7—7 of FIG. 6. It can be seen that teeth 8 (or 5) engage with hole 23 (or 22) where detents 38 contribute to more positive engagement.

In one practical example, the strap of FIGS. 1–7 intended for binding a stack of standard size newspaper had an overall length of 123 cm, and a width of 4 cm. Tongue 2 was 16 cm long, the distances between seams 26 and 27 was determined by the width of a standard size newspaper and was 31 cm. Holes 22 and 23 had a diameter equal to 6.5 mm, and slot 34 was 8 cm long. The strap was made of recycled paperboard, 1 mm thick, in a single die-cut operation.

USE OF THE BUNDLING STRAP OF FIGS. 1–7

In order to tie an object such as a bundle 40 of newspapers, the bundle is placed on section 10 of the bundling strap, which is laid flat on the ground. The ends of the bundling strap are then overlapped so that teeth 5 and 8 of serrated section 6 mate with the two longitudinal rows of holes 22 and 23. Next, flaps 18 and 20 are folded along the rows of holes 22 and 23 over serrated portion 6 of the bundling strap, and tab 28 of flap 20 is inserted through slot 34 in flap 18. In order to prevent the lock from opening, ears 32 and 33 of tab 28 are folded at an angle to the direction of the longitudinal side edges of the strap to prevent tab 28 from slipping back through slot 34. Detents 38, which naturally occur as a result of folding the paperboard, serve as an additional means to provide positive engagement between teeth 5 and 8 and their respective holes 22 and 23. To make the bundle snug, tongue 2 is pulled while holding onto tang 36.

Alternatively, an object can be bundled by first folding flaps 18 and 20, inserting tab 28 through slot 34, and folding ears 32 and 33 to prevent tab 28 from slipping back through slot 34. Next, the strap is wrapped around the object to be bundled, tongue 2 is inserted through space 21 created in locking section 16, and finally tongue 2 is pulled while holding onto tang 36, until the bundle is snug.

Unlocking or incremental adjustment of the bundling strap can be accomplished by flattening ears 32 and 33, pulling tab 28 out of slot 34, opening flaps 18 and 20, and releasing serrated section 6 from rows of holes 22 and 23. Serrated section 6 can then be removed or repositioned as desired.

FIGS. 8 AND 9—DETAILED DESCRIPTION OF ANOTHER EMBODIMENT

Figure 8:
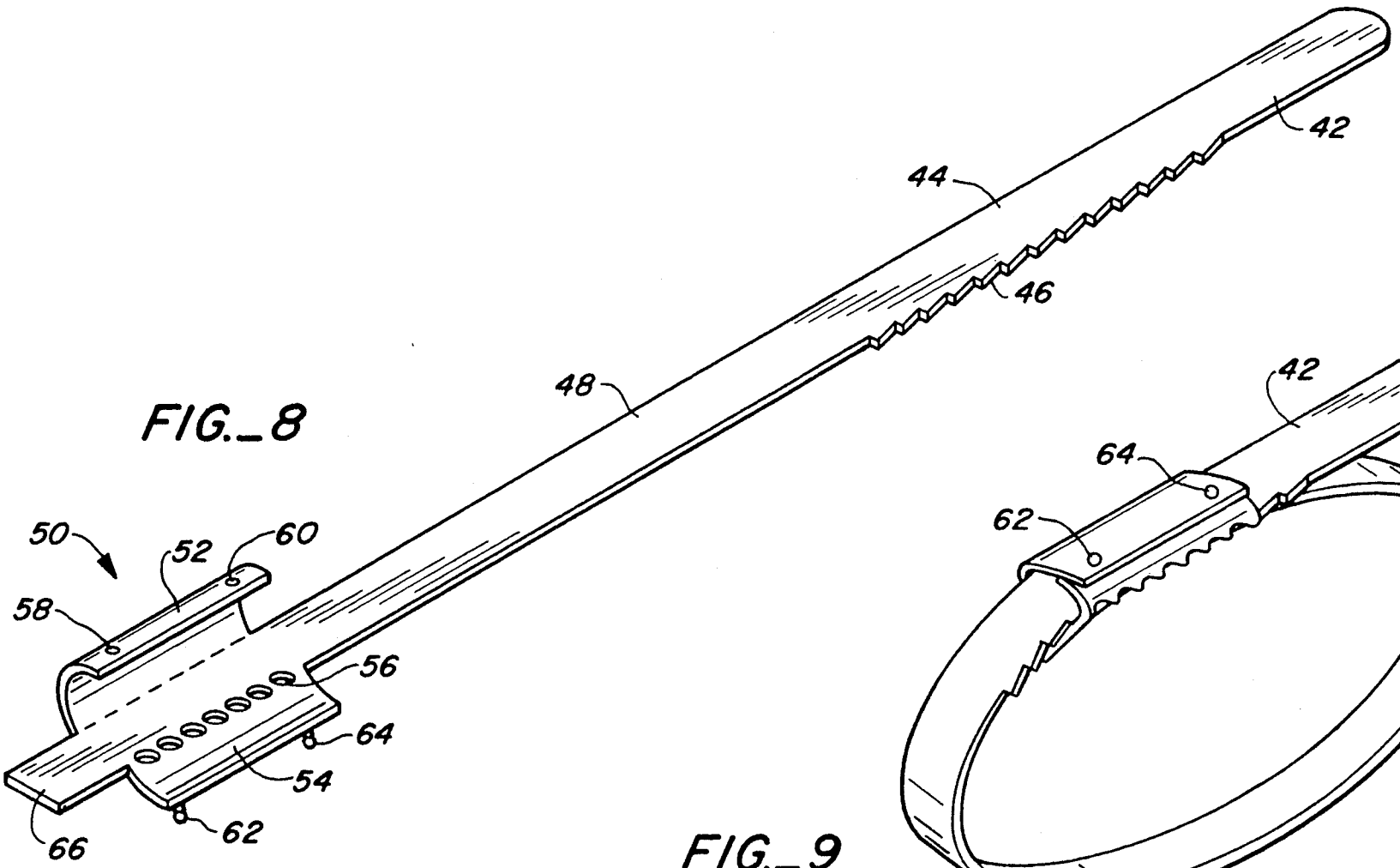
FIG. 8 is a perspective view of a bundling strap made in accordance with another embodiment of the invention.

FIG. 8 is a perspective view of a bundling strap made in accordance with another embodiment of the invention. As shown, the strap is a piece of cardboard which consists of the following main parts arranged sequentially: a tongue 42; a serrated portion 44 with a plurality of uniformly spaced teeth 46 along one longitudinal edge thereof; a smooth section 48 of uniform width, and locking section 50, which comprises flaps 52 and 54.

Locking section 50 also contains a longitudinal row of uniformly spaced round holes 56, centered on a line which in effect is a continuation of the side edge of section 48.

Flap 52 contains holes 58 and 60, located near the longitudinal edge of flap 52. Flap 54 houses snap protrusions 62 and 64, the spacing of which matches the spacing of holes 58 and 60. A tang 66 forms an outward longitudinal extension of section 50, and is coaxial with section 48.

Figure 9:
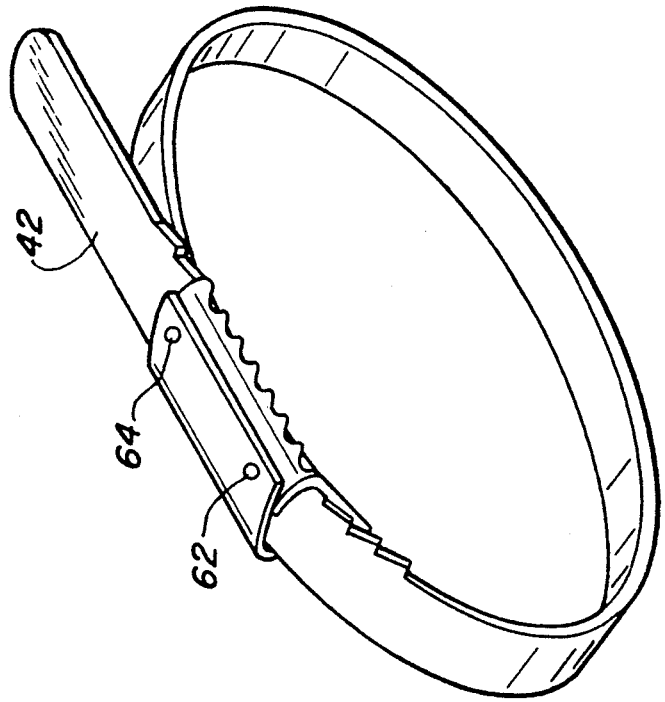
FIG. 9 is a perspective view of the strap of FIG. 8 in a folded and locked state.

FIG. 9 is a perspective view of the strap of FIG. 9 in a folded and locked state. (An object to be bundled is not shown.)

The strap of FIGS. 8 and 9 can be made of plastic and is intended for bundling heavier objects.

USE OF OTHER EMBODIMENTS OF THE BUNDLING STRAP (FIGS. 8–9)

In order to tie an object, such as a bundle of newspapers, with the strap of FIGS. 8 and 9, the object is placed on section 48 of the strap, which is laid flat on the ground. The ends of the strap are then overlapped so that the saw teeth 46 of serrated section 44 mate with the longitudinal row of holes 56. Next, flap 54 is folded at the holes over the serrated portion 44 of the strap, while flap 52 is folded along the edge of section 48, so that snap protrusions 62 and 64 engage their respective holes 58 and 60.

Unlocking and incremental adjustment of the strap of FIGS. 8 and 9 can be accomplished by unsnapping flaps 52 and 54, opening the flaps, and pulling or pushing on tongue 42, while holding onto tang 66 at the locking end of the flap. Pulling tongue 42 will tighten the bundling strap, and pushing on tongue 42 will loosen the strap.

If necessary, this strap can be reused.

SUMMARY, RAMIFICATIONS, SCOPE

Thus, it has been shown that the bundling strap of the invention is inexpensive to manufacture, convenient to store and transport, easy to use, can be adapted to bundle items of different sizes and shapes, is safe for household applications, allows bundles to be stacked on top of each other, does not require adhesive or a frame, and can be die cut from cardboard or cardboard wastes in one operation.

Although the bundling strap has been shown and described in the form of two specific embodiments, these embodiments, their parts, materials, and configurations have been given only as examples. Many other modifications of bundling straps are possible. For example, the straps can be used for bundling other objects such as piles of laundry, books, boxes, etc. Tab 28, tang 36, tongue 2, and flaps 18 and 20 may have configurations different from those shown in the drawings. Tongue 2, recesses 12 and 13, shoulders 14 and 15, and tang 36 can all be eliminated. Holes 22 and 23 can be rectangular, oval, etc. The bundling straps can be made of hard paper, cardboard, plastic, and metal. Buttons or bendable projections can be used instead of the snap elements shown in FIG. 8. The strap can be made without seams 7, 26, and 27, or these seams may be located in any other places to conform to the configuration of the object to be bundled. The strap can be stored and transported in a straightened form without folding. One side of the strap can be colored to indicate the outer side of the strap when it is wrapped around the object. This may be required for correct orientation of teeth in self-locking position.

Therefore, the scope of the invention should be determined, not by the example given, but by the appended claims and their legal equivalents.

What I claim is:

1. A bundling strap for bundling various objects, including newspapers, comprising:

an elongated flat member having opposite insertion and grasping ends, a pair of opposed flat sides, and a pair of opposite edges, said flat sides being between said opposite edges, at least one tooth on at least one of said edges of said flat member at said insertion end thereof;

said grasping end of said elongated flat member comprising a portion having a pair of opposite edges, said portion being widened with respect to said insertion end so as to form a widened portion, said widened portion having at least one bendable flap on one of said edges thereof, said grasping end of said elongated flat member having at least one through hole, said through hole being sized so that said tooth can be inserted therein, retaining means on said widened portion of said flat member for retaining said widened portion of said flat member in a slot configuration when said bendable flap has been folded so that said widened portion has said slot configuration, whereby said bundling strap can be stamped from a flat blank and said grasping end thereof can be folded into a retaining slot without the need for the use of plastic material or an expensive molding process, thereby enabling said bundling strap to be made of cardboard and to be made economically enough to be disposable.

2. The bundling strap of claim 1, further including at least one tooth on the other of said edges of said flat member at said insertion end thereof and a plurality of said through holes on said grasping end, said holes being spaced to mate with said teeth when said insertion end is mated with said slot.

3. The bundling strap of claim 1, said flat member further including a middle portion located between said insertion end and said grasping end, said middle portion having at least one transverse score line to facilitate folding said strap around an object to be bundled.

4. The bundling strap of claim 1 wherein said retaining means comprises positive locking means on said bendable flap.

5. The bundling strap of claim 4 wherein said retaining means further comprises second positive locking means which is engageable with said first-named positive locking means.

6. The bundling strap of claim 1 wherein said widened portion has a second bendable flap on said other of said pair of opposite edges thereof.

7. The bundling strap of claim 6 wherein said retaining means comprises first positive locking means on one of said bendable flaps and second positive locking means on the other of said bendable flaps.

8. The bundling strap of claim 7 wherein said first positive locking means comprises a bendable tab with at least one bendable ear, and said second positive means comprises a longitudinal slot, said slot having a length corresponding to the length of said bendable tab when said ear is in an unfolded state so that said tab can be passed through said slot and said ear can be bent at an angle to the direction of said longitudinal edges, thus preventing disengagement of said tab from said slot.

9. The bundling strap of claim 1 wherein said retaining means comprises at least one hole on one of said bendable flaps and at least one snap element on the other of said bendable flaps for snap engagement in at least said one hole.

10. The bundling strap of claim 1, further including a pulling tang protruding outward in a longitudinal direction from an end of said grasping end.

11. The bundling strap of claim 1, further including a tongue portion at said insertion end of said flat member adjacent to said tooth.

12. The bundling strap of claim 1, further including a plurality of said teeth along said one edge and a plurality of said through holes on said widened portion.

13. The bundling strap of claim 12 wherein said through holes are arranged in a longitudinal row, said teeth having the same pitch as said holes.

14. The bundling strap of claim 1 wherein said elongated flat member is made of paperboard.

15. A bundling strap for bundling various objects, including newspapers, comprising:

an elongated flat member having insertion and grasping ends, a pair of opposed flat sides, and a pair of opposite edges, said opposed flat sides lying between said opposite edges, at least one tooth on each of said opposite edges of said flat member at said insertion end thereof;

said grasping end of said elongated flat member comprising a portion which is widened with respect to said insertion end, said grasping end of said elongated flat member having at least two through holes therethrough, said through holes being arranged to that said teeth can be inserted respectively therein, retaining means on said widened portion of said flat member for retaining said widened portion of said flat member in a slot configuration when said widened portion has been folded into said slot configuration, whereby said bundling strap can be stamped from a flat blank and said grasping end thereof can be folded into said slot configuration without the need for the use of plastic materials or an expensive molding process, thereby enabling said bundling strap to be made of cardboard and to be made economically enough to be disposable.

16. The bundling strap of claim 15 wherein said teeth are pointed and are inclined so that their apices face said grasping end when said flat member is flat.

17. The bundling strap of claim 15, further including a pulling tang protruding outward in the longitudinal direction from an end of said grasping end, and a tongue portion located at said insertion end of said flat member adjacent said tooth.

18. The bundling strap of claim 17, further including a plurality of creases arranged in a transverse direction of said flat member to provide fold lines on said flat member and to facilitate folding thereof, said creases being located in predetermined places determined by a configuration of said object to be bundled.

19. The bundling strap of claim 15 wherein said elongated flat member is made of paperboard.

20. A bundling strap for bundling various objects, such as newspapers, comprising:

an elongated member which is flat when unfolded, said member having insertion and grasping ends, a pair of opposed flat sides, and a pair of opposite edges, said flat sides lying between said opposite edges, at least one tooth on one of said edges of said flat member at said insertion end thereof;

said grasping end of said elongated flat member comprising a portion which is widened with respect to said insertion end, said grasping end of said elongated flat member having at least one through hole, said through hole being arranged so that said tooth can be inserted therethrough, said widened portion being folded to form a slot configuration, and retaining means on said widened portion of said flat member for retaining said grasping end of said flat member in said slot configuration, whereby said bundling strap can be stamped from a flat blank and said grasping end thereof can be folded into said retaining slot without the need for the use of plastic materials or an expensive molding process, thereby enabling said bundling strap to be made of cardboard and to be made economically enough to be disposable.

* * * * *